US008240618B1

(12) United States Patent
Luetzow

(10) Patent No.: US 8,240,618 B1
(45) Date of Patent: Aug. 14, 2012

(54) MULTIPLE DIRECTION RAILROAD GATE RELEASE MECHANISM

(75) Inventor: Edwin J. Luetzow, Brookings, SD (US)

(73) Assignee: MTR Technologies, Inc., Brookings, SD (US)

( * ) Notice: Subject to any disclaimer, the term of this patent is extended or adjusted under 35 U.S.C. 154(b) by 589 days.

(21) Appl. No.: 12/001,104

(22) Filed: Dec. 10, 2007

(51) Int. Cl.
*B61L 23/00* (2006.01)
*E01F 13/00* (2006.01)

(52) U.S. Cl. ..... 246/111; 49/9

(58) Field of Classification Search ..... 246/111–113, 246/114 A, 473 R, 473.1, 477; 49/9, 49, 49/141

See application file for complete search history.

(56) References Cited

U.S. PATENT DOCUMENTS 4,219,969 A * 9/1980 Reinitz et al. ..... 49/141
4,897,960 A 2/1990 Barvinek et al.
5,442,878 A 8/1995 Flores
5,992,800 A 11/1999 Sass
6,327,818 B1 * 12/2001 Pease ..... 49/49
6,470,626 B2 * 10/2002 Luetzow et al. ..... 49/9
6,672,008 B1 * 1/2004 Luetzow et al. ..... 49/9
6,966,146 B2 * 11/2005 Pease ..... 49/49
2011/0113690 A1 5/2011 Luetzow et al.

* cited by examiner

*Primary Examiner* — S. Joseph Morano
*Assistant Examiner* — R. J. McCarry, Jr.
(74) *Attorney, Agent, or Firm* — Schwegman, Lundberg & Woessner, P.A.

(57) ABSTRACT

A multiple direction railroad gate release mechanism which is attached between the mount arms of a railroad gate actuator and a crossing arm to prevent breakage of the crossing arm due to impingement in either a frontal or rearward direction by a vehicle or other outside force. A primary pivot arm assembly allows a released movement of the crossing arm in reaction to frontal impingement and returns the crossing arm to the original and detent position subsequent to an impingement in order to maintain grade crossing protection. Spring assemblies, a shock absorber and a spring centering assembly act to return the primary pivot arm assembly and attached crossing arm to a normal detent position. A secondary pivot arm assembly is secured to the primary pivot arm assembly whereby the secondary pivot arm assembly can act independently of the primary pivot arm assembly to allow released movement and return of the crossing arm in reaction to rear impingement.

19 Claims, 11 Drawing Sheets

MULTIPLE DIRECTION RAILROAD GATE RELEASE MECHANISM

CROSS REFERENCES TO RELATED APPLICATIONS

None.

BACKGROUND OF THE INVENTION

1. Field of the Invention

The present invention is for a railroad gate release mechanism, and in particular, for a multiple direction railroad gate release mechanism which allows for maintaining the structural integrity of a railroad grade crossing arm when struck from one or more directions by an automotive vehicle. Although a multiple direction railroad gate release mechanism is described, the release mechanism can be used for other gates such as, but not limited to, parking lot gates, restricted access gates, road closure gates, toll gates, crowd control gates and the like.

2. Description of the Prior Art

Railroad crossing grades are protected by railroad grade crossing arms which are stored substantially in a vertical position and which are actuated by railroad gate actuators. The actuators reorient the crossing arms to a horizontal position across a railroad crossing grade. The crossing arms warn operators of vehicles of oncoming train traffic and physically place a barrier in the form of a crossing arm at both sides of the railroad crossing grade to discourage and prevent the passage of a vehicle into the railroad crossing grade. Motorists unaware of the movement of a crossing arm may impinge either the front or the back of the crossing arm to the extent that physical damage may occur whereby the crossing arm is broken or parted from the railroad gate actuator. In some situations, the motorist may physically damage a first crossing arm or may avoidingly maneuver the motor vehicle around the end of the first crossing arm whereby damaging impact with a second opposed crossing can result. Such an occurrence can compromise the safety of the railroad grade crossing in that other motorists will not be warned of impending danger due to the destruction of one or more of the crossing arms. Such occurrences will compromise safety as well as add a financial maintenance burden.

SUMMARY OF THE INVENTION

The general purpose of the present invention is to provide a multiple direction railroad gate release mechanism.

According to one embodiment of the present invention, there is provided a multiple direction railroad gate release mechanism for attachment between a railroad gate actuator and a crossing arm. The mechanism includes opposing channel shaped brackets which attach to the railroad gate actuator and which also serve as a mounting structure for other components. Reference is made to the multiple direction railroad gate release mechanism as deployed in a horizontal situation across a railroad crossing grade. A primary pivot arm assembly to which a secondary pivot arm assembly and a crossing arm are attached, pivotally mounts between vertically opposed top and bottom bearing support plates located on the inwardly facing surfaces of opposed channel shaped brackets. The primary pivot arm assembly is pivotable for the most part in a clockwise direction or to a lesser extent in a counterclockwise direction from a centered detent neutral position until limited by contacting limit stops. For example and illustration, the primary pivot arm assembly is pivotable 45° clockwise about a pivot pin and is pivotable 15° counterclockwise about the pivot pin. The primary pivot arm assembly is influenced by a detent and plunger arrangement which maintains a combined perpendicular relationship of the primary pivot arm assembly, the secondary pivot arm assembly and the attached crossing arm with respect to the railroad gate actuator until acted upon by outside forces. Most commonly, an outside force impinges one or more of the crossing arms when the crossing arms are deployed horizontally across both sides of a crossing grade, such as a vehicle impinging the front (approach) side of one of the crossing arms from a roadway. Such front side impingement causes the multiple direction railroad gate release mechanism, with the attached secondary pivot arm assembly and crossing arm, to pivotally overcome the influence of the detent and plunger arrangement and to swing horizontally out of the way of the oncoming impinging vehicle. Impingement from the front side of the crossing arm from a roadway can occur without functional damage to the crossing arm. Such pivotal yielding substantially reduces the possibility of breakage of the crossing arm, as little bending moment is actually applied along the crossing arm itself due to the substantially unrestricted repositioning yielding movement allowed by the multiple direction railroad gate release mechanism. Subsequent to such impingement and when the vehicle has ceased to contact the crossing arm, top and bottom spring assemblies function to return the primary pivot arm assembly of the multiple direction railroad gate release mechanism with the attached secondary pivot arm assembly and crossing arm to the detent and neutral centered position to continue to offer gated protection at the railroad crossing grade, especially for those vehicles approaching from the abutting roadway. A shock absorber allows for rapid rate pivoting of the primary pivot arm assembly and attached secondary pivot arm assembly and attached crossing arm in one direction during impingement and allows for a slower rate return of the primary pivot arm assembly and attached members in the return direction subsequent to impingement. The centering spring assembly assists in returning of the primary pivot arm assembly to the detent position in the case of a return overshoot.

Additional protection of the crossing arm is afforded in the opposite direction with respect to a vehicle on the actual crossing grade, i.e., a vehicle on the tracks which approaches and impinges the back side of the crossing arm. The secondary pivot arm assembly is pivotally mounted to the primary pivot arm assembly and extends outwardly therefrom to accommodate attachment of the crossing arm to offer relief from a crossing arm back side impingement. The secondary pivot arm assembly pivots in a counterclockwise direction about a pivot pin located near the end of the primary pivot arm assembly. Top and bottom spring assemblies function to return the secondary pivot arm assembly and maintain the combined perpendicular relationship of the primary pivot arm assembly, the secondary pivot arm assembly, and the attached crossing arm with respect to the railroad gate actuator.

One significant aspect and feature of the present invention is a multiple direction railroad gate release mechanism which is secured between the mount arms of a railroad gate actuator and a crossing arm.

Another significant aspect and feature of the present invention is a multiple direction railroad gate release mechanism which, when impinged, releasably allows a breakaway positioning in two directions of a crossing arm from a normal and detent position in order to prevent damage to the crossing arm.

Another significant aspect and feature of the present invention is a multiple direction railroad gate release mechanism which allows the return positioning of a crossing arm to a normal and detent position subsequent to a breakaway positioning caused by impingement.

Still another significant aspect and feature of the present invention is a multiple direction railroad gate release mechanism which offers grade crossing protection subsequent to crossing arm impingement.

Still another significant aspect and feature of the present invention is a multiple direction railroad gate release mechanism having a secondary pivot arm assembly pivotally attached to a primary pivot arm assembly where the secondary pivot arm assembly can operate in concert with the primary pivot arm assembly or can operate independently of the primary pivot arm assembly.

Yet another significant aspect and feature of the present invention is the use of cables attached to the primary pivot arm assembly which are influenced by springs in spring assemblies which springs are compressed during impingement with the front side of a crossing arm and which are used to subsequently power the return of the primary pivot arm assembly, attached secondary pivot arm assembly and attached crossing arm assembly to an original neutral and detent position.

A further significant aspect and feature of the present invention is the use of a shock absorber which allows rapid deployment of the primary pivot arm assembly having an attached secondary pivot assembly and attached crossing arm during frontal crossing arm impingement and which allows return of the primary pivot arm assembly having the attached secondary pivot arm assembly and crossing arm at a slower rate subsequent to impingement, whereby the slower return rate reduces the possibility of a return overshoot of the primary pivot arm assembly, attached secondary pivot arm assembly and attached crossing arm assembly.

Yet another significant aspect and feature of the present invention is the use of swing stops which limit the travel of the primary pivot arm assembly in clockwise and counterclockwise rotational movements in order to prevent overstressing or other damage to the cables used in the associated spring assemblies.

Yet another significant aspect and feature of the present invention is the use of stop plates or other structure which limit the travel of the secondary pivot arm assembly in a counterclockwise rotational movement in order to prevent overstressing or other damage to the cables used in the associated spring assemblies.

A still further significant aspect and feature of the present invention is the use of a centering spring assembly which urges the primary pivot arm assembly into a normal and detent position when a returning primary crossing arm assembly, attached secondary pivot arm assembly, and attached crossing arm assembly overshoot a neutral detent position.

Having thus described an embodiment of the present invention and having set forth significant aspects and features thereof, it is the principal object of the present invention to provide a multiple direction railroad gate release mechanism.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
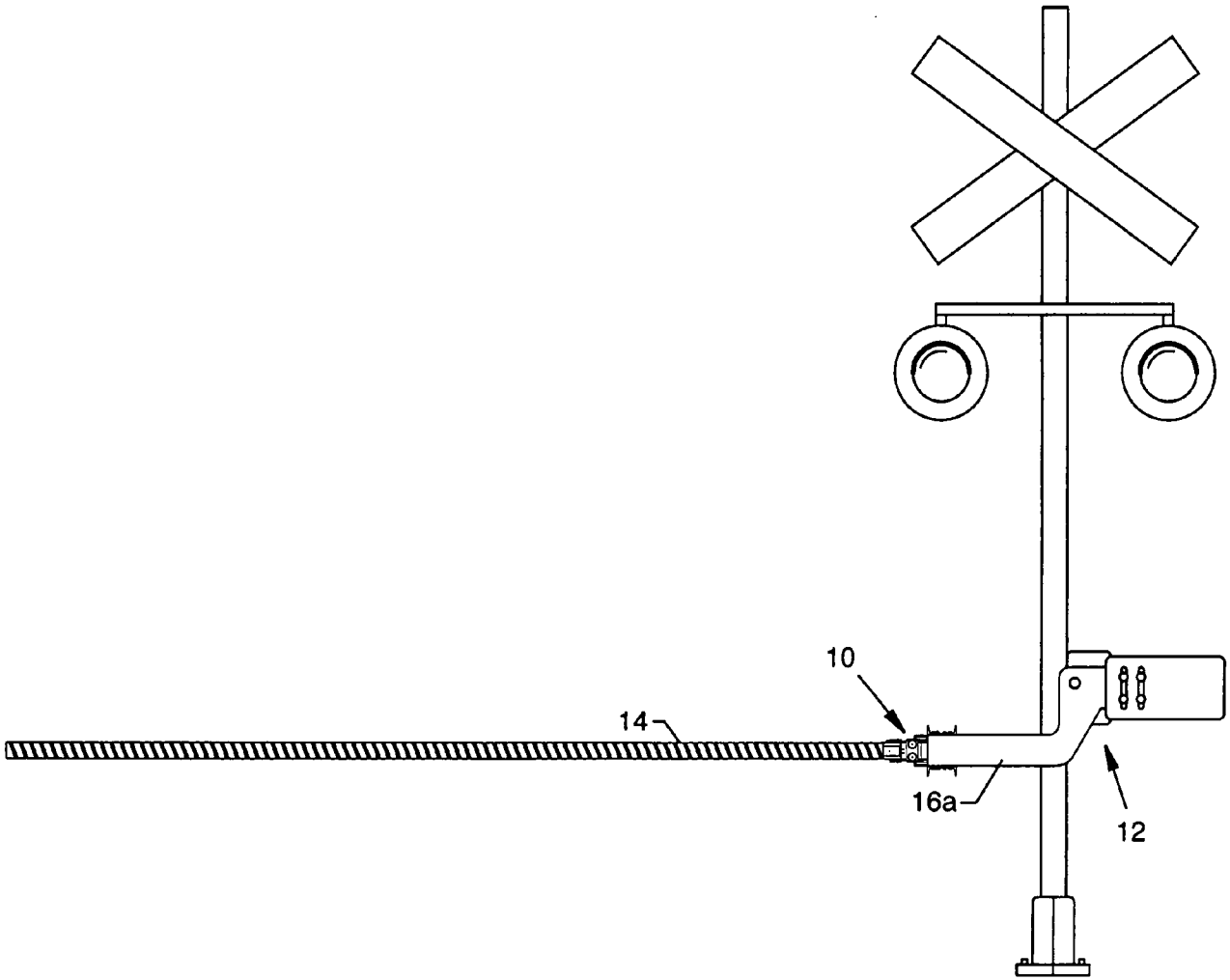
FIG. 1 illustrates the use of a multiple direction railroad gate release mechanism, the present invention, wherein a railroad gate actuator is shown in the actuated position to position the multiple direction railroad gate release mechanism and the attached crossing arm in a horizontal position.

FIG. 1 shows the use of the multiple direction railroad gate release mechanism 10 of the present invention. A railroad gate actuator 12 is shown in the actuated position to position the multiple direction railroad gate release mechanism 10 and attached crossing arm 14 in a horizontal position. The multiple direction railroad gate release mechanism 10 is mounted between the ends of the mount arms 16*a* and 16*b* (FIG. 2) and the crossing arm 14 is mounted to the multiple direction railroad gate release mechanism 10.

Figure 2:
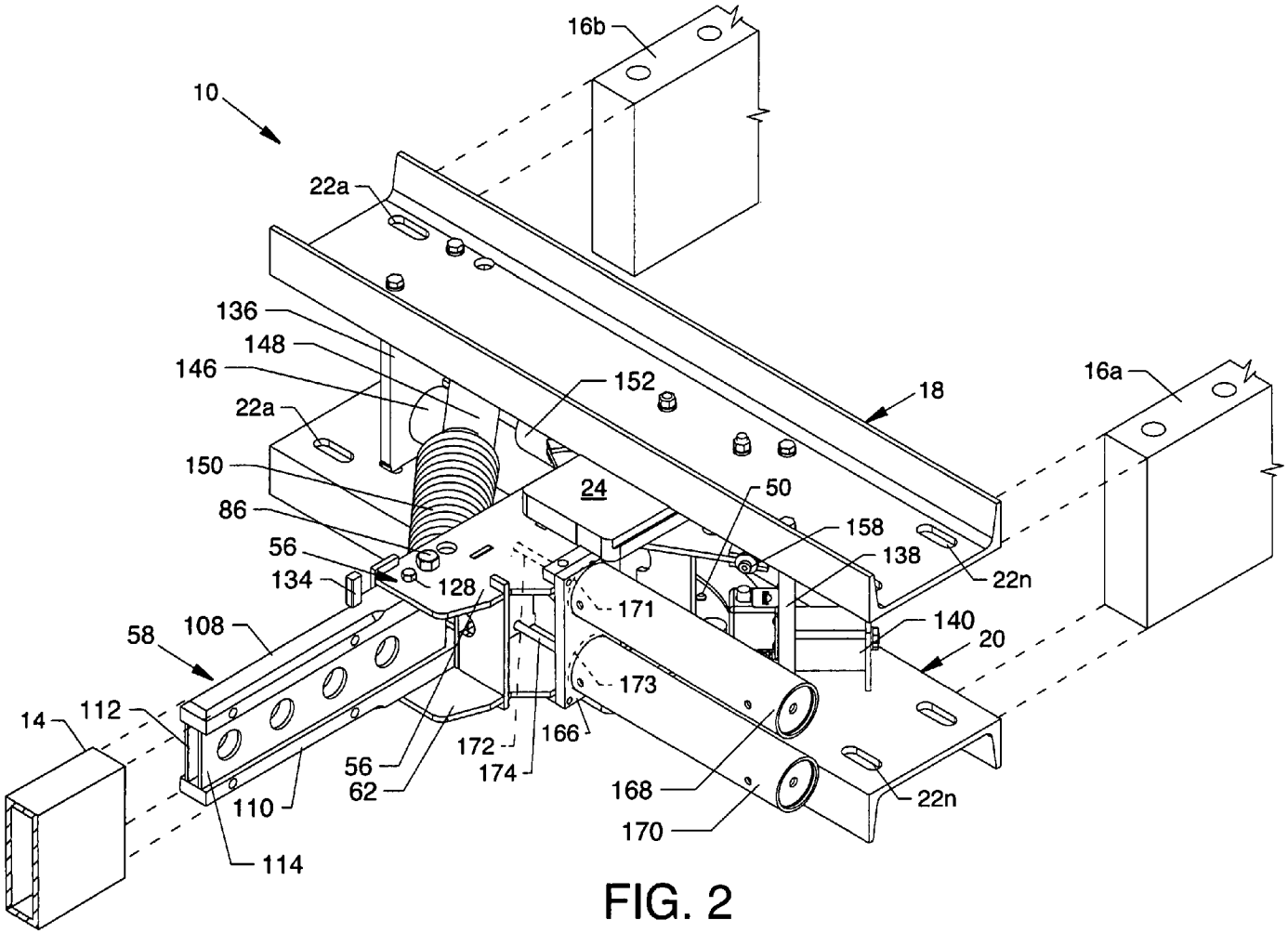
FIG. 2 is a right side isometric view of the multiple direction railroad gate release mechanism, the present invention, along with portions of mount arms and a crossing arm which are associated therewith in use.

FIG. 2 is a right side isometric view of the multiple direction railroad gate release mechanism 10 of the present invention showing its connecting relationship between mount arms 16*a* and 16*b* of the railroad gate actuator 12 and the crossing arm 14. Top and bottom mounting brackets 18 and 20 in the form of channels accommodate attachment of the mount arms 16*a* and 16*b*. The crossing arm 14 is secured over and about a secondary pivot arm assembly 58 of the multiple direction railroad gate release mechanism 10, each of which is shown in a horizontal position, such as for stopping traffic at a railroad grade crossing.

Figure 3:
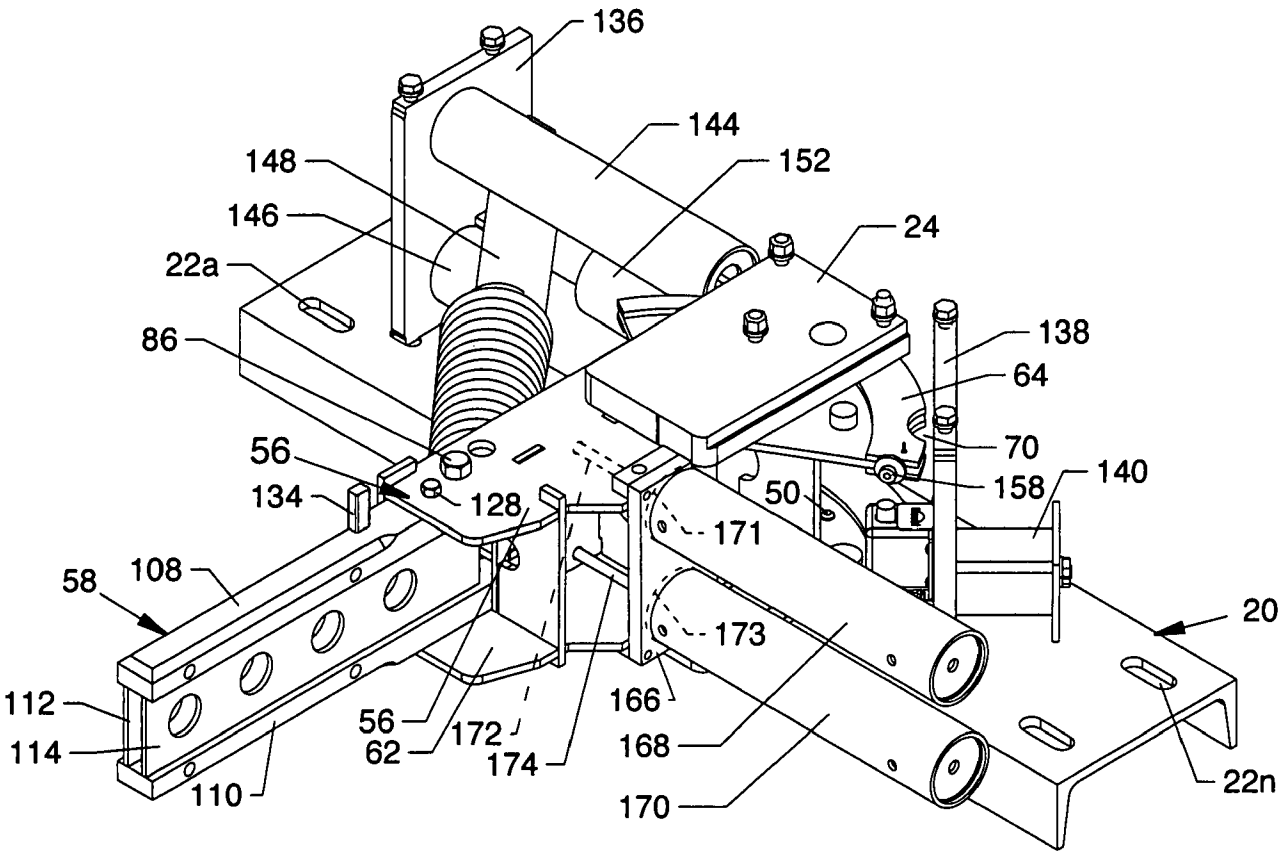
FIG. 3 is a right side isometric view of the multiple direction railroad gate release mechanism with a top bracket removed.
Figure 4:
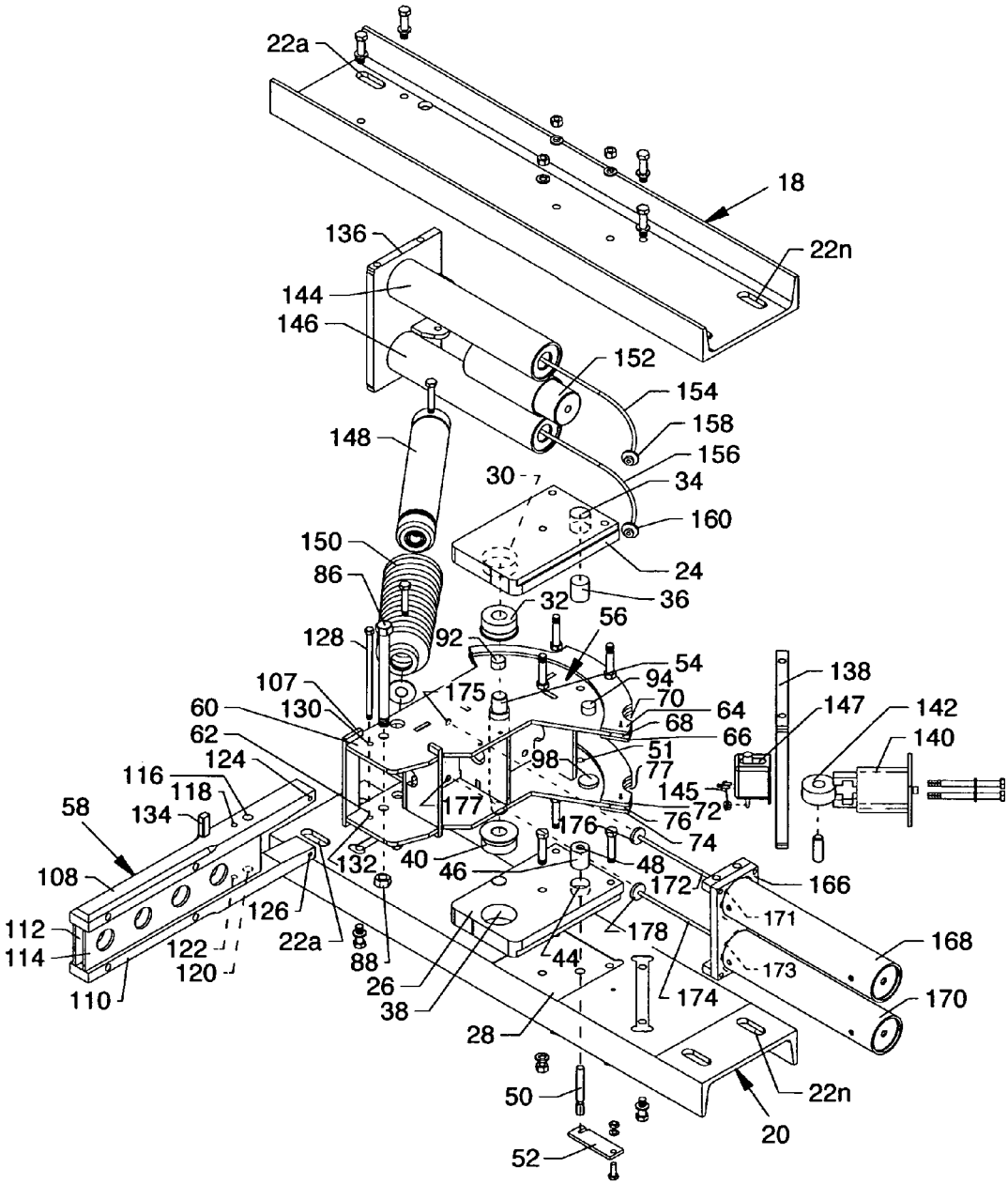
FIG. 4 is an exploded isometric view of the components of the invention shown in FIG. 2.
Figure 5:
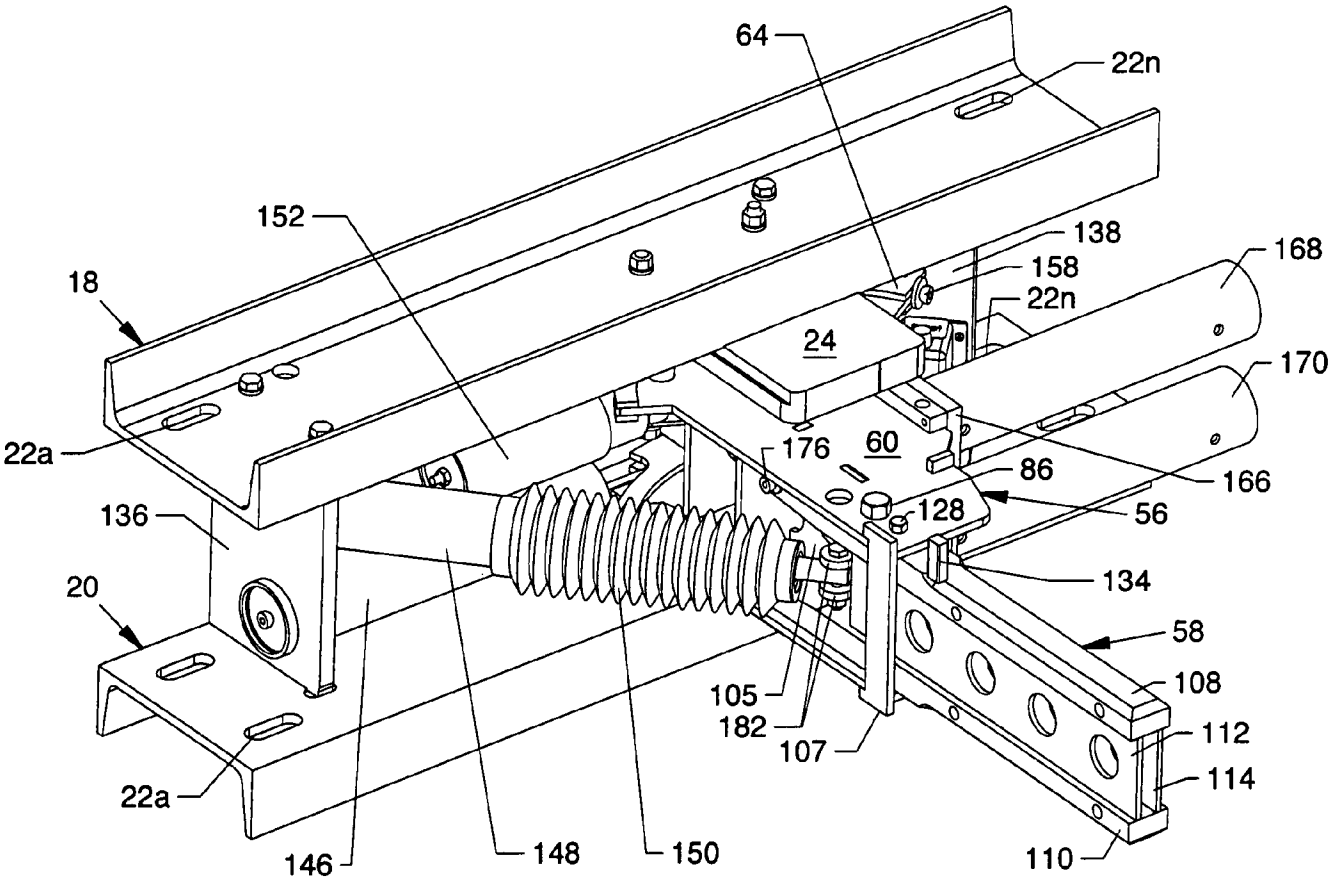
FIG. 5 is left side isometric view of the multiple direction railroad gate release mechanism.
Figure 6:
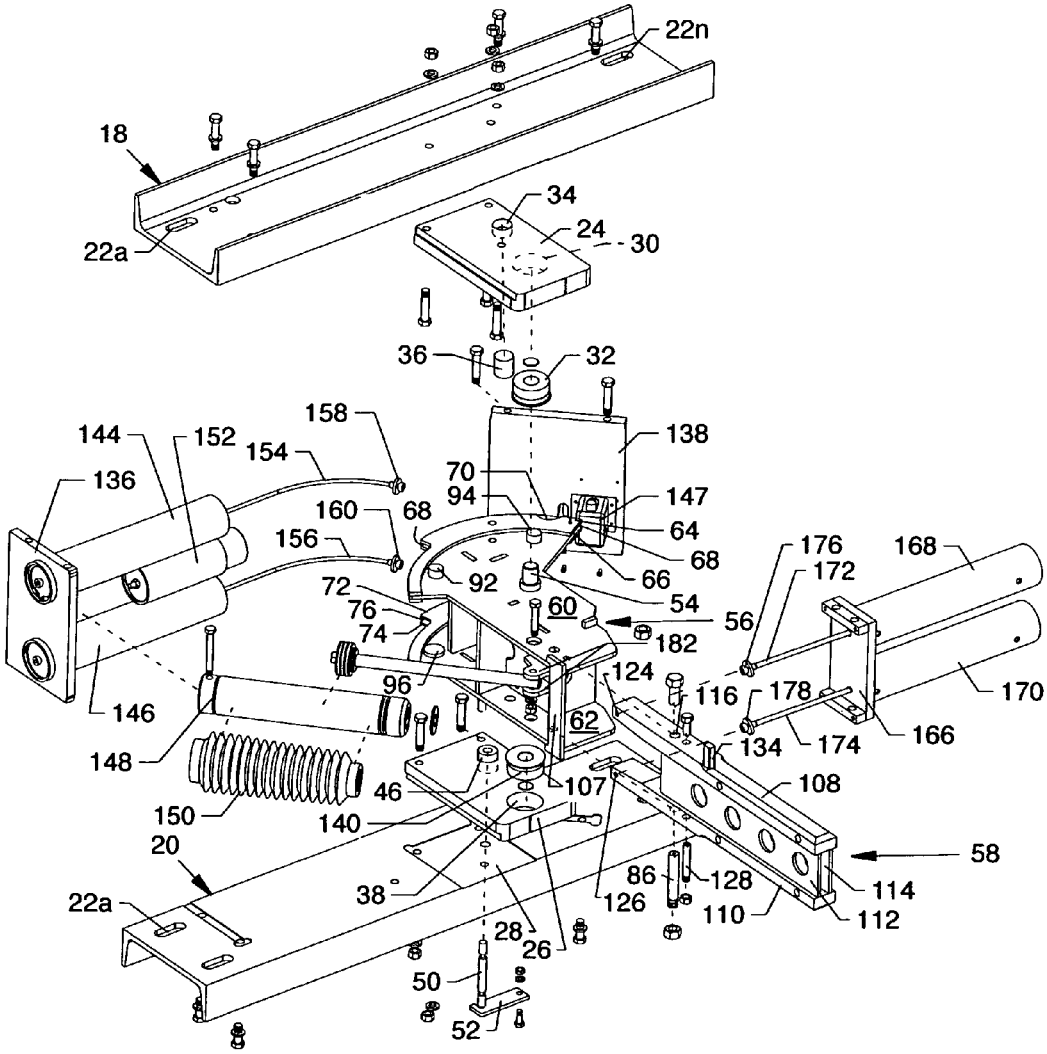
FIG. 6 is an exploded isometric view of the components of the invention shown in FIG. 5.

Multiple views of the invention are included for a full understanding of the present invention including isometric views, exploded isometric views, and isometric views of several components generally shown in a horizontal orientation as deployed across a crossing grade. FIG. 3 is a right side isometric view of the multiple direction railroad gate release mechanism 10 with a top bracket 18 (FIG. 2) removed for the purpose of clarity. FIG. 4 is an exploded isometric view of the components of the invention shown in FIG. 2. FIG. 5 is left side isometric view of the multiple direction railroad gate release mechanism 10. FIG. 6 is an exploded isometric view of the components of the invention shown in FIG. 5. With respect to the above figures, the invention is further described. In the invention, a plurality of nuts, bolts, and lock washers are secured through a plurality of holes in a plurality of diverse components as is common practice in the art and as are shown or indicated in engagement or alignment wherever practicable or suitable in the accompanying illustrated figures.

Partial or fully visible components of the multiple direction railroad gate release mechanism 10 include opposing top and bottom mounting brackets 18 and 20 in the form of a channel, each having a plurality of mounting holes 22*a*-22*n* used in the attachment of mount arms 16*a* and 16*b* of the railroad gate actuator 12, as well as other holes and features for mounting other components thereto. Opposed top and bottom bearing support plates 24 and 26 are preferably aligned with recessed surfaces on the inwardly facing surfaces of the top and bottom mounting brackets 18 and 20 are suitably secured thereto; one such recessed surface 28 is shown in FIG. 4. The top bearing support plate 24 includes a circular recess 30 opening downwardly for the fixed accommodation of a top bearing assembly 32. The top bearing support plate 24 also includes a hole 34 for the fixed accommodation of a stop pin 36 having of a greater vertical dimension than the thickness dimension of the top bearing support plate 24. The bottom portion of such a top stop pin 36 extends downwardly a short distance beyond the bottom surface of the top bearing support plate 24. Also, the bottom bearing support plate 26 includes a circular recess 38 opening upwardly for the fixed accommodation of a bottom bearing assembly 40. The bottom bearing support plate 26 also includes a hole 44 for the protected accommodation of a bottom stop pin 46 having of a greater vertical dimension than the thickness dimension of the bottom bearing support plate 26. The top portion of such a bottom stop pin 46 extends upwardly a short distance beyond the top surface of the bottom bearing support plate 26. The bottom stop pin 46 includes a vertically aligned central bore 48, thus enabling the accommodation of a replaceable protective shear pin 50, the latter of which extends vertically and upwardly through the bottom mounting bracket 20. The protective shear pin 50 extends further to align coaxially and indirectly through the hole 44 and coaxially and directly into the central bore 48 of the bottom stop pin 46. The top portion of the repalceable shear pin 50 extends upwardly beyond the top surface of the bottom stop pin 46 to engage a hole 51 in a bottom swing plate 62. The replaceable shear pin 50 is secured to the bottom of the bottom mounting plate 20 by means of a moveable retainer plate 52. A connection between the top bearing support plate 24 and the bottom bearing support plate 26 is provided by a vertically oriented pivot pin 54 extending therebetween. Opposed ends of the vertically oriented pivot pin 54 are aligned within and extend between the top bearing assembly 32 and the bottom bearing assembly 40 and functions as support for a primary pivot arm assembly 56 described later in detail. A secondary pivot arm assembly 58 is pivotally supported by and extends outwardly from the primary pivot arm assembly 56. The pivot pin 54 extends through and is secured to the structure of the primary pivot arm assembly 56.

Figure 7:
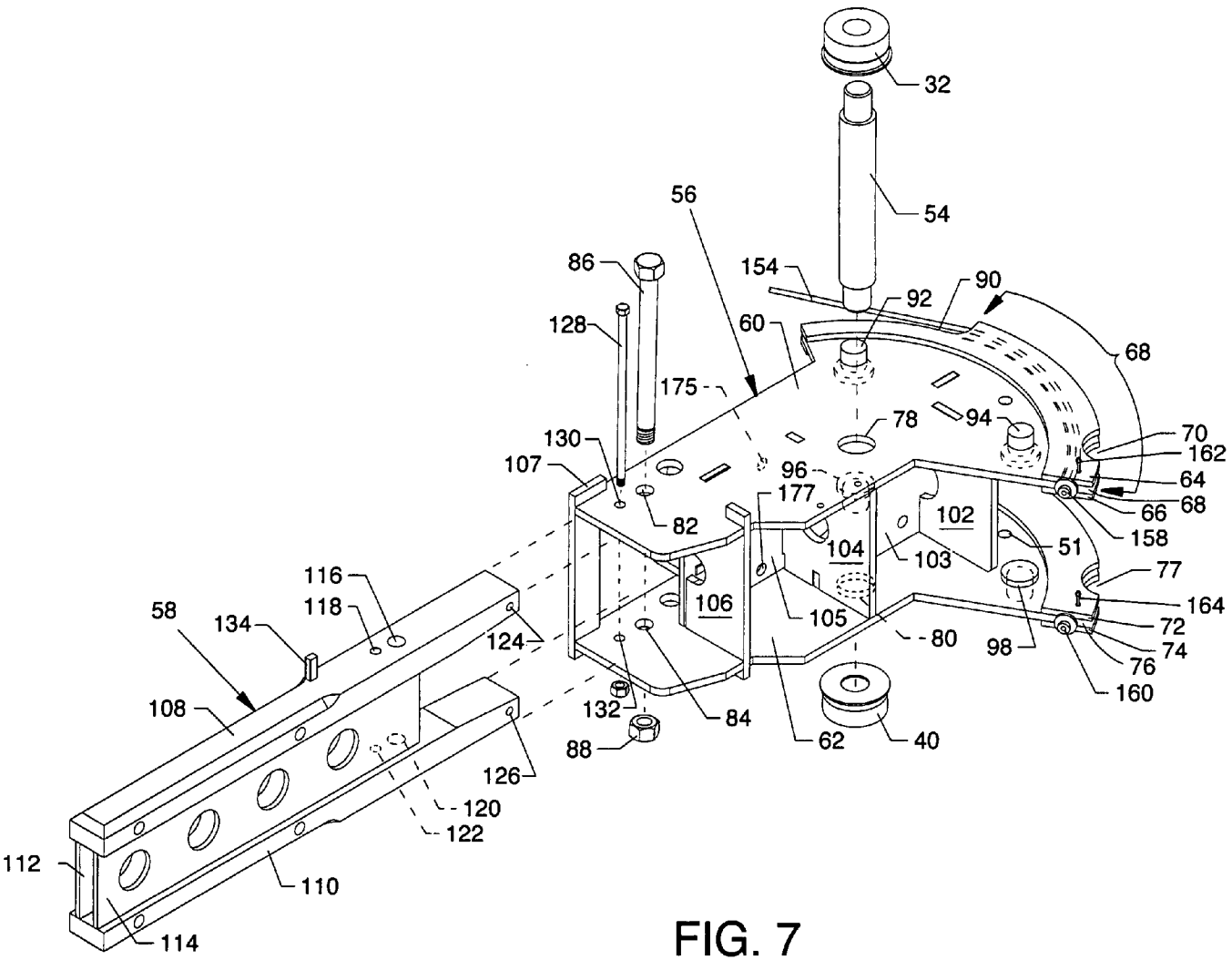
FIG. 7 is an isometric view of the primary and secondary arm assemblies and other closely associated components.

The primary pivot arm assembly 56 is aligned between the top and bottom bearing support plates 24 and 26, respectively, and is mounted and pivotally secured therebetween by the pivot pin 54 which is in close intimate contact with the top bearing assembly 32 and the bottom bearing assembly 40. The primary pivot arm assembly 56 includes, in part, opposing geometrically configured and vertically spaced top and a bottom swing plates 60 and 62. As viewed in FIG. 7, one end of the top swing plate 60 is arcuate in shape and accommodates the secured mounting of opposed arcuate top and bottom cable guide plates 64 and 66. The top and bottom cable guide plates 64 and 66 extend beyond the edge of the arcuate end of the top swing plate 60 to form an arcuate cable channel 68 therebetween. A semicircular detent 70 is formed by semicircular cutouts in each of the top and bottom cable guide plates 64 and 66, the combination of which forms the detent 70. The bottom swing plate 62 is made substantially similar to the top swing plate 60 and includes opposing arcuate top and bottom cable guide plates 72 and 74 to form an arcuate cable channel 76. A semicircular detent 77 is formed by semicircular cutouts in each of the top and bottom cable guide plates 72 and 74, the combination of which forms the detent 77. It is noted that the cable channel 68 and the cable channel 76 are abbreviated with respect to the full arcuate length of the top cable guide plate 64, the bottom cable guide plate 66, the top cable guide plate 72, and the bottom cable guide plate 74, respectively, in order to allow room for accommodation of spring assembly structures described later in detail. Such abbreviation is provided by reducing the width, i.e., a reduction of the radius of the top cable guide plate 64, the bottom cable guide plate 66, the top cable guide plate 72 and the bottom cable guide plate 74, such as representatively shown at reference 90 at the top cable guide plate 64. A hole 78 (FIG. 7) is included at the pivot axis of the primary pivot arm assembly 56 in the top swing plate 60 in opposed alignment with a hole 80 in the bottom swing plate 62 for accommodating of the opposed ends of the pivot pin 54. The body of the pivot pin 54 is suitably secured in the holes 78 and 80 such as by weldments. The ends of the pivot pin 54 extend beyond the top and bottom surfaces of the top swing plate 60 and the bottom swing plate 62 in order to fittingly accommodate the top bearing assembly 32 and the bottom bearing assembly 40, respectively. Another set of opposed holes is located at one end of the primary pivot arm assembly 56 including a hole 82 in the top swing plate 60 in opposed alignment with a hole 84 in the bottom swing plate 62 for accommodation of a pivot pin 86 in the form of a bolt which is secured therein by a nut 88. The pivot pin 86 is used to pivotally secure the secondary pivot arm assembly 58 to the primary pivot arm assembly 56 using holes 82 and 84 and pivot holes 116 and 120, each of which is shown in FIG. 7. Swing stops 92 and 94 are mounted in the top swing plate 60 and swing stops 96 and 98 are mounted in the bottom swing plate 62 in order to limit rotation of the primary pivot arm assembly 56 at clockwise and counterclockwise limits, as described below. Each swing stop is shouldered and protrudes through holes in the respective top or bottom swing plate 60 and 62. The swing stops 92 and 94 protrude upwardly through and slightly beyond the top surface of the top swing plate 60 in order to impinge the top stop pin 36 mounted in and extending downwardly from the top bearing support plate 24. The swing stops 96 and 98 protrude downwardly through and slightly beyond the bottom surface of the bottom swing plate 62 in order to impinge the bottom stop pin 46 extending from the bottom bearing support plate 26. Swing stops 92 and 96 provide a clockwise rotation stop at approximately 45° from center, for example, and the swing stops 94 and 98 provide a counterclockwise rotation stop at approximately 15° from center, for example and illustration. Vertically aligned tabbed brace plates 102, 103, 104, 105 and 106 are aligned and secured between the top swing plate 60 and the bottom swing plate 62, thereby connecting the top swing plate 60 and the bottom swing plate 62. A vertically oriented support plate 107 connects one edge of the top swing plate 60 to a corresponding edge of the bottom swing plate 62.

The secondary pivot arm assembly 58 includes opposed horizontally aligned top and bottom bars 108 and 110, respectively. Opposed vertically aligned and spaced plates 112 and 114 are aligned and secured between the top and bottom bars 108 and 110. The top bar 108 includes a vertically aligned pivot hole 116 and a juxtaposed vertically aligned hole 118, each extending through the top bar 108. Correspondingly, the bottom bar 110 includes a vertically aligned pivot hole 120 and a juxtaposed vertically aligned hole 122, each extending through the bottom bar 110 in alignment with the pivot hole 116 and the hole 118 of the top bar 108. The inboard ends of the top bar 108 and the bottom bar 110 are aligned between the outboard ends of the top swing plate 60 and the bottom swing plate 62 and are pivotally connected to the pivot pin 86. The pivot pin 86 extends through holes 82 and 84 of the top swing plate 60 and the bottom swing plate 62 and through the holes 116 and 120 of the top and bottom bars 108 and 110, respectively. Horizontally aligned cable adapter holes 124 and 126 extend through the inboard ends of the top and bottom bars 108 and 110, respectively. A replaceable shear pin 128 which generally prevents pivoting of the secondary pivot arm assembly 58 with respect to the primary pivot arm assembly 56, is installed in holes 130 and 132, respectively, at the end of the top swing plate 60 and the bottom swing plate 62 and through holes 118 and 122 in the top and bottom bars 108 and 110. A stop bar 134 is located on the top bar 108 of the secondary pivot arm assembly 58 which is used to align the inboard end of the crossing arm 14 along the secondary pivot arm assembly 58.

Having described the structure of a plurality of components comprising the primary pivot arm assembly 56 and the secondary pivot arm assembly 58, and parts and components closely associated therewith thereto, other components and associated structure, which influence the static and the actuated states before, during, and after impingement of a crossing arm 14 by an outside force either to the front or to the rear of a crossing arm 14, are now described referring primarily to FIGS. 3, 4, 5 and 6. A vertically aligned left brace plate 136 and right brace plate 138 are mounted vertically between the top mounting bracket 18 and the bottom mounting bracket 20 such that the left brace plate 136 and right brace plate 138 serve as mounts for other components, as well as assisting in structural support for various previously described components.

Certain components are useful in maintaining position of as well as protecting and returning a displaced crossing arm 14 to a centered neutral position following the impingement on the front of the crossing arm 14 by an outside force. A plunger housing 140, including a spring loaded movable round end plunger 142, is mounted on the right brace plate 138. The round end plunger 142 extends through an opening in the right brace plate 138 in order to engage the detent 77 in the bottom swing plate 62 of the primary pivot arm assembly 56 and to maintain the position of the primary pivot arm assembly 56 in a static and centered neutral position, whereby the crossing arm 14 is maintained in an extended horizontal position across a grade crossing. Upon a forcible impingement on the front side of the crossing arm 14, the primary pivot arm assembly 56 is forced to rotate about the pivot pin 54 and simultaneously the top of the shear pin 50 is sheared whereby such movement drives the round end plunger 142 from the detent 77. Subsequent to disengagement of the round end plunger 142 from the detent 77, other forces, as provided by the operation of other components of the invention, serve to return the primary pivot arm assembly 56 to a static and centered neutral position, whereby the round end plunger 142 forcibly re-engages the detent 77. A collection of return components is associated directly or indirectly with the left brace plate 136 including pivotally mounted top and bottom spring assemblies 144 and 146, a shock absorber 148 having a cover 150 pivotally secured to the left brace plate 136 and a centering spring assembly 152 secured between the free ends of the top and bottom spring assemblies 144 and 146. Cables 154 and 156 extend from the top and bottom spring assemblies 144 and 146 to engage the length of the cable channels 68 and 76, respectively. Cable ball and washer assemblies 158 and 160 are affixed to the ends of the cables 154 and 156, respectively, and are aligned at one end of the cable channels 68 and 76, respectively. The ends of the cables 154 and 156 are positionally secured in the cable channels 68 and 76 by pins 162 and 164 (FIG. 7) extending through the top cable guide plate 64 and the bottom cable guide plate 66 and extending through the top cable guide plate 72 and the bottom cable guide plate 74, respectively, at a position outboard of and in close proximity to the cables 154 and 156. A connector assembly 145 connects between the round end plunger 142 support structure and an event counter 147 which is attached to the inside surface of the right brace plate 138.

Certain components are useful in protecting and returning a displaced crossing arm 14 to a centered neutral position with respect to impingement of the rear of the crossing arm 14 by an outside force. A vertically aligned bracket assembly 166 is secured to the edges of the top swing plate 60 and the bottom swing plate 62 of the primary pivot arm assembly 56 as a mount for a top and bottom spring assembly 168 and 170. The top and bottom spring assemblies 168 and 170 are suitably secured in annular grooves 171 and 173 in the bracket assembly 166. The ends of cables 172 and 174 (FIG. 4) extend from the top and bottom spring assemblies 168 and 170 through body holes 175 and 177 in the tabbed brace plate 105 (FIG. 7) and engage the cable connection holes 124 and 126 at the inboard ends of the top bar 108 and the bottom bar 110 of the secondary pivot arm assembly 58, respectively. Cable ball and washer assemblies 176 and 178 are affixed to the ends of cables 172 and 174, respectively, in order to retain the ends of the cables 172 and 174 within the cable connection holes 124 and 126, respectively.

Figure 8:
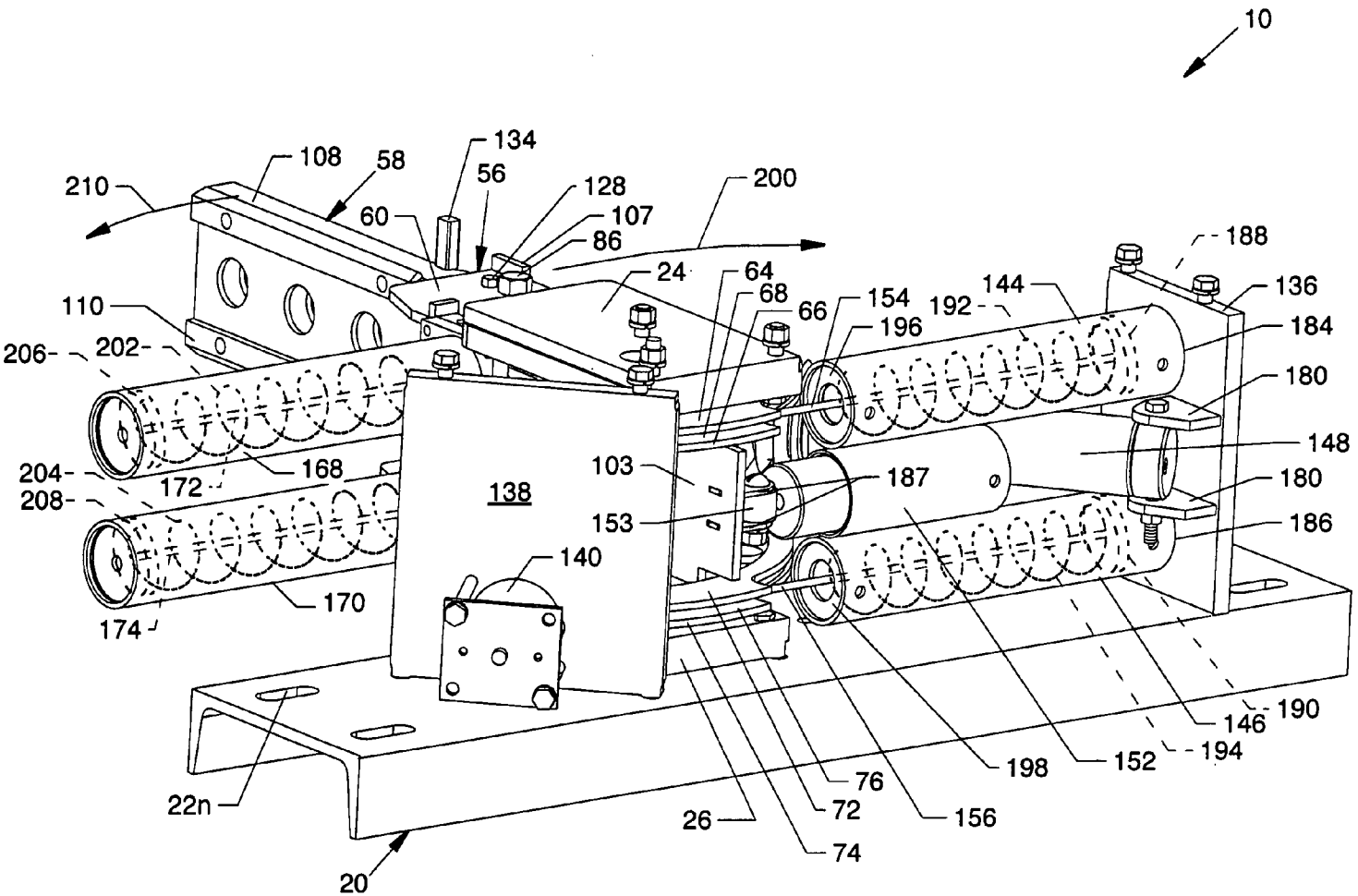
FIG. 8 is a rear isometric view of the multiple direction railroad gate release mechanism.

FIG. 8 is a rear isometric view of the elements shown in FIG. 3. Illustrated, in particular, is the relationship of the primary pivot arm assembly 56 with respect to the top and bottom spring assemblies 144 and 146, the centering spring assembly 152, and the shock absorber 148. Similar spaced mounting brackets 180 are secured to the left brace plate 136. One end of the shock absorber 148 is pivotally secured to the mounting brackets 180 and the other end of the shock absorber 148 is pivotally secured to spaced mounting brackets 182 on the rear of the tabbed brace plate 105 of the primary pivot arm assembly 56, as shown in FIG. 5. The shock absorber 148 when moved to a compressed position allows for the rapid rotational movement of the primary pivot arm assembly 56 from and beyond the neutral detent position during impingement of the front side of the crossing arm 14. The shock absorber 148 allows for a slower rate of movement when returning to the centered neutral position to suitably control the return rate of the primary pivot arm assembly 56 subsequent to impingement of the front side of the crossing arm 14. The body of the centering spring assembly 152 is secured, as previously described, between the outboard ends of the top and bottom spring assemblies 144 and 146. The free end of the centering spring assembly 152 closely juxtaposes a roller 153 mounted to the tabbed brace plate 103 by the use of spaced mounting brackets 187. The centering spring assembly 152 is used to urge and assist the primary pivot arm assembly 56 to return to a normal and detent position if a return over shoot occurs, as described later in detail. The horizontally oriented top and bottom spring assemblies 144 and 146 are aligned and suitably secured in bores 184 and 186 in the left brace plate 136. One end of cables 154 and 156 is secured by cable ball and washer assemblies 158 and 160 (FIG. 4), as previously described. The cables 154 and 156 are aligned in the cable channels 68 and 76 of the top and bottom swing plates 60 and 62, respectively. The other ends of the cables 154 and 156 are secured to circular plates 188 and 190 located inside of the top and bottom spring assemblies 144 and 146. Springs 192 and 194 are located interior to the top and bottom spring assemblies 144 and 146 between the circular plates 188 and 190 and the inward facing ends 196 and 198 of the top and bottom spring assemblies 144 and 146. Clockwise pivotal movement of the primary pivot arm assembly 56 about the pivot pin 54 also carries the attached secondary pivot arm assembly 58 in a clockwise direction as indicated by arrow 200 in a unitary clockwise movement. Such pivotal movement causes compression of the springs 192 and 194 to provide a built-up energy for subsequent spring powered action of the primary pivot arm assembly 56 (and the attached non-pivoted secondary pivot arm assembly 58) to return the primary pivot arm assembly 56 to its normal centered neutral detent position subsequent to frontal impingement of the crossing arm 14.

As partially shown in FIG. 8 and with understood reference to previously described figures, the relationship of the secondary pivot arm assembly 58 to the top and bottom spring assemblies 168 and 170 is now described. Springs 202 and 204 are located interior to the top and bottom spring assemblies 168 and 170 and are attached to and located between each of the circular plates 206 and 208 and the inward facing ends (not shown) of the top and bottom spring assemblies 168 and 170. Pivotal movement of the secondary pivot arm assembly 58 in a counterclockwise direction about the pivot pin 86 as indicated by arrow 210 is caused by impingement to the rear of the crossing arm 14 resulting in shearing of the shear pin 128 and in compression of the springs 202 and 204 through the cables 172 and 174. Such pivotal movement provides built-up energy for subsequent spring powered action by the top and bottom spring assemblies 168 and 170 to cause the secondary pivot arm assembly 58 to return to its normal position against the tabbed brace plate 105 subsequent to rearward impingement of the crossing arm 14.

Figure 9:
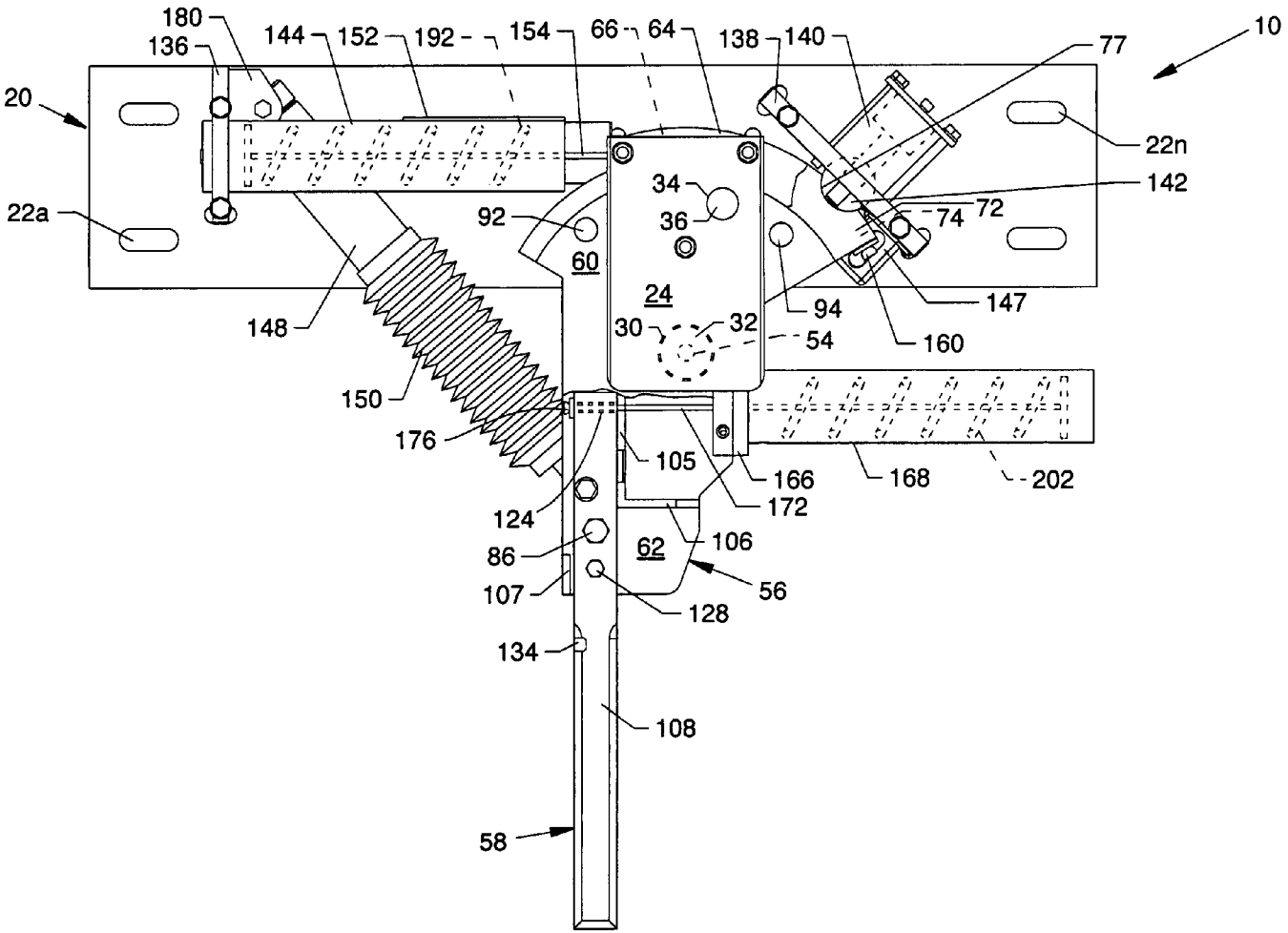
FIG. 9 is a top view of the multiple direction railroad gate release mechanism in partial cutaway showing its normal detent position when in use to deploy an attached crossing arm attached thereto.

FIG. 9 is a top view of the multiple direction railroad gate release mechanism 10 in partial cutaway showing its normal detent centered neutral position when in use to deploy an attached crossing arm 14 (not shown) across a railroad grade crossing. The top cable guide plate 64 and underlying bottom cable guide plate 66 are shown in partial cutaway to reveal the detent 77 of the primary pivot arm assembly 56. The portion of the top swing plate 60 located outboard of the tabbed brace plate 104 is cutaway in order to reveal and/or demonstrate the connection of the cable 172 (and the cable 174, not shown) to the inboard ends of the top bar 108 and the bottom bar 110 (not shown) of the secondary pivot arm assembly 58. The spring loaded round end plunger 142 forcibly and intimately engages the detent 77 of the primary pivot arm assembly 56 to maintain the neutral position of the primary pivot arm assembly 56 when the crossing arm 12 (FIG. 2) is extended across a railroad crossing grade. The spring loaded round end plunger 142 has a sufficient outwardly directed force to maintain the primary pivot arm assembly 56 including the secondary pivot arm assembly 58 and the attached crossing arm 14 in the desired centered neutral detent orientation in either a raised or lowered position or positions therebetween to maintain the desired proper orientation extending across the crossing grade unless impinged from either side by a vehicle or other outside force.

MODE OF OPERATION

Figure 10:
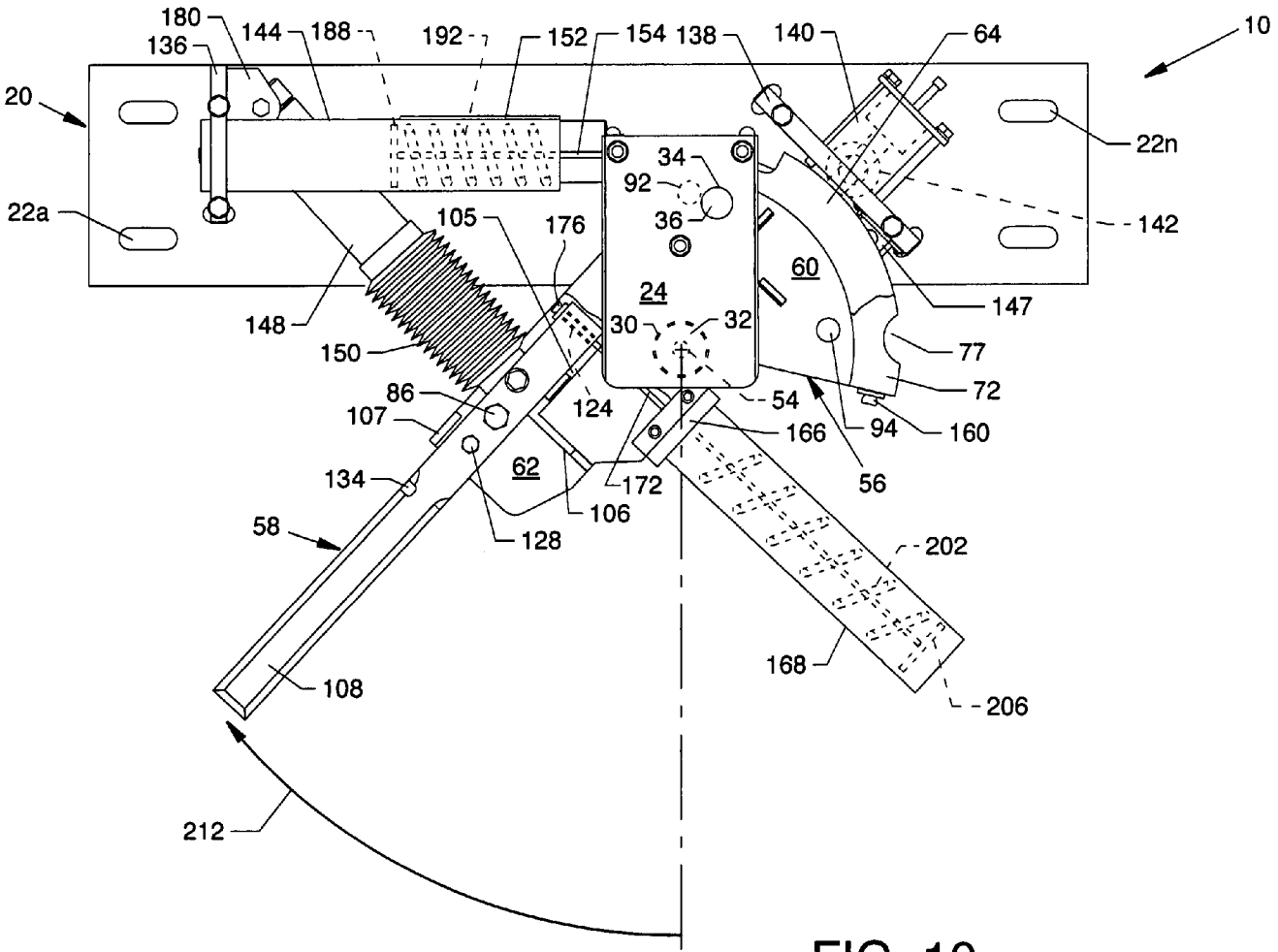
FIG. 10 is a top view of the multiple direction railroad gate release mechanism in partial cutaway illustrating the mode of operation of the multiple direction railroad gate release mechanism when an attached crossing arm is forcibly impinged from the front side; and, FIG. 11 is a top view of the multiple direction railroad gate release mechanism in partial cutaway and best illustrates the mode of operation of the multiple direction railroad gate release mechanism when an attached crossing arm is forcibly impinged from the back side.

FIG. 10 is a top view of the multiple direction railroad gate release mechanism 10 in partial cutaway, as described in FIG. 9, and best illustrates the mode of operation of the multiple direction railroad gate release mechanism 10 when an attached crossing arm 14 (not shown) is forcibly impinged from the front side. Impingement of the front side of the attached crossing arm 14 by a vehicle or other object forces causes pivoting of the primary pivot arm assembly 56 in a clockwise direction, as viewed from the top, about the pivot pin 54 as shown by arrow 212. Such forced pivoting causes a shearing of the top of the shear pin 50 and also causes forced disengagement of the spring loaded round end plunger 142 from the detent 77, whereby the round end plunger 142 tangentially and slidingly contacts the major portion of the outer edge of the arcuate top and bottom cable guide plates 72 and 74, respectively, of the primary pivot arm assembly 56, thus allowing the primary pivot arm assembly 56 and attached secondary pivot arm assembly 58 to pivot unitarily, thereby preserving the integrity of the attached crossing arm 14. During such forced unitary pivoting about the pivot pin 54, the angular relationship of the primary pivot arm assembly 56 and attached secondary pivot arm assembly 58 is unchanged with respect to each other. Clockwise pivoting of the primary pivot arm assembly 56 and attached secondary pivot arm assembly 58 is allowed at a suitable and rapid rate and is not significantly influenced by the shock absorber 148 in order that the crossing arm 14 can be rapidly deployed without breakage. However, return of the primary pivot arm assembly 56 and attached secondary pivot arm assembly 58 to the centered neutral detent position is influenced by the shock absorber 148 which acts to allow counterclockwise return pivoting at a rate much less than that during impingement caused by the clockwise pivoting. During frontal impingement caused by the clockwise pivoting of the primary pivot arm assembly 56 and attached secondary pivot arm assembly 58, the spring 192 in the top spring assembly 144 and the spring 194 in the bottom spring assembly 146 (FIG. 8) are compressed by the movement of the cables 154 and 156, respectively, one end of which resides in and is secured in the cable channels 68 and 76 located at the ends of the top swing plate 60 and the bottom swing plate 62, respectively. Such spring compression provides a force to subsequently return the primary pivot arm assembly 56 and attached secondary pivot arm assembly 58 toward and into the centered neutral detent position at a controlled rate as provided by the shock absorber 148, as previously described. Clockwise rotation is limited by impingement of the swing stop 92 of the top swing plate 60 with the top stop pin 36 of the top bearing support plate 24 as shown and by a similar impingement of the swing stop 96 of the bottom swing plate 62 with the bottom stop pin 46 of the bottom bearing support plate 26 (FIG. 4). For purposes of example and demonstration, such clockwise rotation is provided at 45° but shall not be considered to be limiting to the scope of the invention. Such limitation prevents overstressing or breakage of the top and bottom cables 154 and 156 and associated components. In the case of an unintended counterclockwise return overshoot of the detent 77 beyond the spring loaded round end plunger 142, counterclockwise motion is limited to 15° (for purposes of example and demonstration) by impingement of the swing stop 94 of the top swing plate 60 with the top stop pin 36 of the top bearing support plate 24 and by like impingement of the swing stop 98 of the bottom swing plate 62 with the bottom stop pin 46 of the bottom bearing support plate 26 (FIG. 4) to prevent overstressing or breakage of the top and bottom cables 172 and 174. In addition the centering spring assembly 152 can contact the roller 153 to urge and assist the primary pivot arm assembly 56 to return to a normal and centered neutral detent position in the event of a return overshoot, preferably prior to stopping at 15°. Such counterclockwise overshoot protection features ensure that the round end plunger 142 will maintain contact with the minor portion of the outer edge of the arcuate top and bottom cable guide plates 72 and 74, respectively, of the primary pivot arm assembly 56. The counterclockwise overshoot protection prevents the round end plunger 142 from disassociating with the minor portion of the outer edge of the arcuate top and bottom cable guide plates 72 and 74 and extending, for example, into the region of the cable ball and washer assembly 160, whereby an overly directed round end plunger 142 could lock the primary pivot arm assembly 56 and attached secondary pivot arm assembly 58 in a position to one side of the neutral detent position. For purposes of example and demonstration such counterclockwise rotation is provided at a 15° angle but shall not be considered limiting to the scope of the invention.

Figure 11:
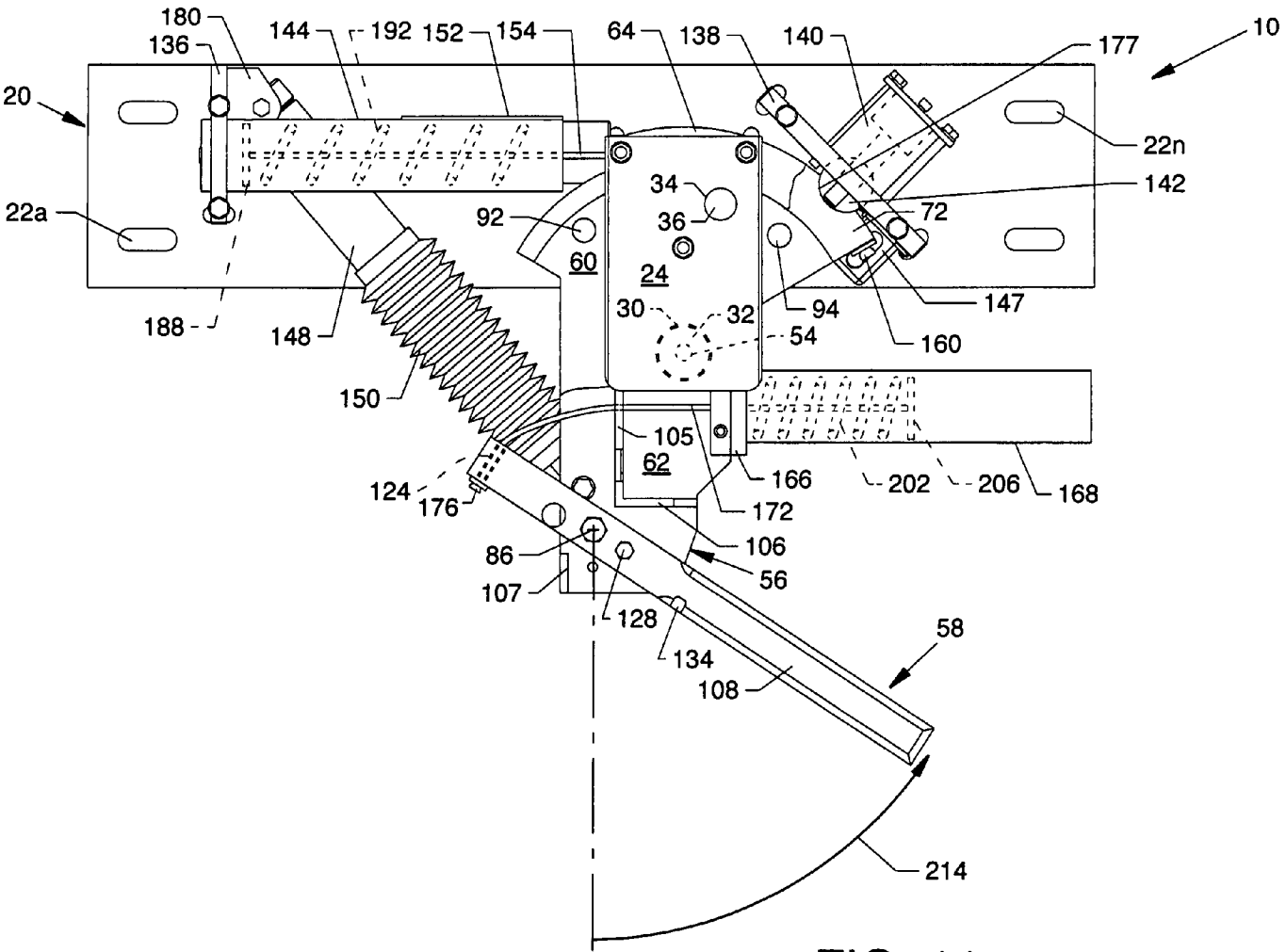

FIG. 11 is a top view of the multiple direction railroad gate release mechanism 10 in partial cutaway, as described in FIG. 9, and best illustrates the mode of operation of the multiple direction railroad gate release mechanism 10 when an attached crossing arm 14 (now shown) is forcibly impinged from the back side. Impingement of the back side of the attached crossing arm 12 by a vehicle or other substantial object causes shearing of the shear pin 128 and pivoting of the secondary pivot arm assembly 58 in a counterclockwise direction, as viewed from the top, about the pivot pin 86 as shown by arrow 214. During rearward impingement causing counterclockwise pivoting of the secondary pivot arm assembly 58, the spring 202 in the top spring assembly 168 and the spring 204 in the bottom spring assembly 170 (not shown) are compressed by the movement of the cables 172 and 174, respectively. Such a spring compression provides a force to subsequently return the secondary pivot arm assembly 58 in a clockwise rotation to intimately contact the tabbed brace plate 105 which is the normal position with respect to the primary pivot arm assembly 56. Counterclockwise rotation is limited by impingement of the top and bottom bars 108 and 110 with the tabbed brace plate 106 which functions as a stop to prevent overstressing or breakage of the top and bottom cables 172 and 174. Additionally, protection is provided in an articulating fashion. If the secondary pivot arm assembly 58 is positioned to invoke stoppage by the tabbed brace plate 106 and further positioned in a counterclockwise manner, additional protection is provided by counterclockwise rotation of the primary pivot arm assembly 56 until limitation by impingement of the swing stop 94 of the top swing plate 60 with the top stop pin 36 of the top bearing support plate 24 and by like impingement of the swing stop 98 of the bottom swing plate 62 with the bottom stop pin 46 of the bottom bearing support plate 26. Thus, pivotal arm relief is provided for either the front side or rear side impingement of the attached crossing arm 14. Shearing of the shear pin in a front impingement of the crossing arm 14 or shearing of the shear pin 128 is an indication to maintenance personnel that the crossing arm 14 has been impacted from the front or rear respectively. Crossing arm protection and function is in effect with the shear pins 50 or 128 in a sheared or un-sheared state.

Various modifications can be made to the present invention without departing from the apparent scope thereof.

MULTIPLE DIRECTION RAILROAD GATE RELEASE MECHANISM PARTS LIST

| | |
|---|---|
| 10 | multiple direction railroad gate release mechanism |
| 12 | railroad gate actuator |
| 14 | crossing arm |
| 16a-b | mount arms |
| 18 | top mounting bracket |
| 20 | bottom mounting bracket |
| 22a-n | mounting holes |
| 24 | top bearing support plate |
| 26 | bottom bearing support plate |
| 28 | recessed surface |
| 30 | circular recess |
| 32 | top bearing assembly |
| 34 | hole |
| 36 | top stop pin |
| 38 | circular recess |
| 40 | bottom bearing assembly |
| 42 | hole |
| 44 | hole |
| 46 | bottom stop pin |
| 48 | bore |
| 50 | shear pin |
| 51 | hole |
| 52 | retainer plate |
| 54 | pivot pin |
| 56 | primary pivot arm assembly |
| 58 | secondary pivot arm assembly |
| 60 | top swing plate |
| 62 | bottom swing plate |
| 64 | top cable guide plate |
| 66 | bottom cable guide plate |
| 68 | cable channel |
| 70 | detent |
| 72 | top cable guide plate |
| 74 | bottom cable guide plate |
| 76 | cable channel |
| 77 | detent |
| 78 | hole |
| 80 | hole |
| 82 | hole |
| 84 | hole |
| 86 | pivot pin |
| 88 | nut |
| 90 | reference |
| 92 | swing stop |
| 94 | swing stop |
| 96 | swing stop |
| 98 | swing stop |
| 102 | tabbed brace plate |
| 103 | tabbed brace plate |
| 104 | tabbed brace plate |
| 105 | tabbed brace plate |
| 106 | tabbed brace plate |
| 107 | support plate |
| 108 | top bar |
| 110 | bottom bar |
| 112 | plate |
| 114 | plate |
| 116 | pivot hole |
| 118 | hole |
| 120 | pivot hole |
| 122 | hole |
| 124 | cable connection hole |
| 126 | cable connection hole |
| 128 | shear pin |
| 130 | hole |
| 132 | hole |
| 134 | stop bar |
| 136 | left brace plate |
| 138 | right brace plate |
| 140 | plunger housing |
| 142 | round end plunger |
| 144 | top spring assembly |
| 145 | connector assembly |
| 146 | bottom spring assembly |
| 147 | event counter |
| 148 | shock absorber |

-continued

| MULTIPLE DIRECTION RAILROAD GATE RELEASE MECHANISM PARTS LIST | |
|---|---|
| 150 | cover |
| 152 | centering spring assembly |
| 153 | roller |
| 154 | cable |
| 156 | cable |
| 158 | cable ball and washer assembly |
| 160 | cable ball and washer assembly |
| 162 | pin |
| 164 | pin |
| 166 | bracket assembly |
| 168 | top spring assembly |
| 170 | bottom spring assembly |
| 171 | annular groove |
| 172 | cable |
| 173 | annular groove |
| 174 | cable |
| 175 | body hole |
| 176 | cable ball and washer assembly |
| 177 | body hole |
| 178 | cable ball and washer assembly |
| 180 | mounting brackets |
| 182 | mounting brackets |
| 184 | bore |
| 186 | bore |
| 187 | mounting bracket |
| 188 | circular plate |
| 190 | circular plate |
| 192 | spring |
| 194 | spring |
| 196 | end |
| 198 | end |
| 200 | arrow |
| 202 | spring |
| 204 | spring |
| 206 | circular plate |
| 208 | circular plate |
| 210 | arrow |
| 212 | arrow |
| 214 | arrow |

It is claimed:

1. An apparatus for connection to a vertical post at a railroad crossing intersection, comprising:

a multiple direction railroad gate release mechanism, said gate release mechanism being attached to one end of a railroad crossing arm and supported by at least one mounting arm attached to the vertical post at a railroad crossing intersection, said gate release mechanism being supported by at least one mounting bracket which is in turn supported by said at least one mounting arm, said gate release mechanism comprising:

a primary pivot arm assembly pivotally connected to the at least one mounting bracket; and a secondary pivot arm assembly being pivotally connected to said primary pivot arm assembly, with one end of said railroad crossing arm fixedly connected to said secondary pivot arm assembly, wherein the primary pivot arm assembly is horizontally rotable around a primary pivot pin of the multiple direction railroad gate release mechanism, the primary pivot arm assembly horizontally rotable in a counterclockwise direction against a first spring bias and in a clockwise direction, opposite the counterclockwise direction, against a second spring bias other than the first spring bias, and wherein the secondary pivot arm assembly is horizontally rotable around a secondary pivot pin of the multiple direction railroad gate release mechanism, the secondary pivot arm assembly freely rotable in the counterclockwise direction against a third spring bias other than the first spring bias and the second spring bias.

2. The apparatus of claim 1, wherein said primary pivot arm assembly includes a top swing plate and a bottom swing plate spaced from said top swing plate with a plurality of spaced brace plates secured therebetween, each of said swing plates having a distal end and a proximal end, with the primary pivot pin connected between said top and bottom swing plates and said distal and proximal ends of said swing plates, and with the secondary pivot pin connected between said proximal ends of said top and bottom swing plates, said secondary pivot arm assembly including an elongated arm with a proximal end and a distal end, said secondary pivot pin between said top and bottom swing plates being operatively connected to said elongated arm near said proximal end thereof and said railroad crossing arm being fixedly attached to said distal end thereof.

3. The apparatus of claim 2, wherein said secondary pivot pin is a bolt passing through opposite holes in said top and bottom swing plates and a nut securing said bolt between said top and bottom swing plates.

4. The apparatus of claim 2, wherein said gate release mechanism includes a top bearing support plate being attached between said top supporting bracket and said top swing plate, a bottom bearing support plate being attached between said bottom swing plate and said bottom supporting bracket, each of said top and bottom bearing support plates having a proximal end and a distal end, a top bearing assembly inserted within a recess in a bottom surface of said top bearing support plate, a bottom bearing assembly inserted within a hole in said bottom bearing support plate, said recess and said hole being in axial alignment with each other and being near the proximal ends of said bearing support plates, and the opposite ends of said primary pivot pin being inserted into said top and bottom bearing assemblies.

5. The apparatus of claim 4, wherein each of said distal ends of said top and bottom swing plates is an arcuate section supporting a pair of spaced arcuate plates forming an arcuate channel for guiding a cable therethrough, each of said arcuate channels having a proximal end and a distal end.

6. The apparatus of claim 5, wherein said gate release mechanism includes a first top spring assembly and a first bottom spring assembly, each of said top and bottom spring assemblies having an elongated cylindrical housing with a proximal end and a distal end, each of said distal ends of said top and bottom cylindrical housings being perpendicularly supported from a vertical brace plate which is fixedly secured between said top and bottom mounting brackets and spaced from said proximal end of said arcuate channels, each of said cylindrical housings having an elongated expanded spring therein and a circular plate therein, each of said springs having a proximal end and a distal end, each of said circular plates being positioned at the distal end of each of said springs, each of said cylindrical housings having a circular plate with a central opening at the proximal end of each of said cylindrical housings, each of said top and bottom housings having an elongated cable extending therefrom, said elongated cable having a proximal end and a distal end, said proximal end of said elongated cable being fixed to said distal circular plate within each of said housings and extending through said cylindrical housing, through said central opening of said circular plate, through said proximal end of said arcuate channel, through the length of said arcuate channel, and a stopper at said distal end of said cable, said stopper being fixed to said distal end of said arcuate channel.

7. The apparatus of claim 6, wherein each of said top and bottom bearing support plates has a top surface and a bottom surface, a stop pin extending from said bottom surface of said top bearing support plate and a stop pin extending from said top surface of said bottom bearing support plate, each of said top and bottom swing plates has a top surface and a bottom surface, a pair of spaced swing stops on said top surface of said top swing plate near said end of said arcuate channel and a pair of spaced swing stops on the bottom surface of said bottom swing plate, said stop pins and spaced swing stops limiting pivotal movement of said primary pivot arm assembly.

8. The apparatus of claim 7, wherein said gate release mechanism further includes a second top spring assembly and a second bottom spring assembly, each of said second top and bottom spring assemblies having an elongated cylindrical housing with a proximal end and a distal end, each of said proximal ends of said second top and bottom elongated cylindrical housings being perpendicularly supported from a bracket assembly attached to the right side of said primary pivot arm assembly and between said proximal and distal ends of said primary pivot arm assembly, each of said elongated cylindrical housings of said second top and bottom spring assemblies having an elongated expanded spring therein and a circular plate therein, each of said springs having a proximal end and a distal end, each of said circular plates being positioned at the distal end of each of said elongated expanded springs, each of said top and bottom housings of said second top and bottom spring assemblies having an elongated cable extending therefrom, said elongated cable having a proximal end and a distal end, said proximal end of said elongated cable being fixed to said distal circular plate within each of said cylindrical housings and extending through said cylindrical housing, through a hole in said bracket assembly, through a hole in one of spaced brace plates of said primary pivot arm assembly, through a cable connection hole in said proximal end of said elongated arm of said secondary pivot arm assembly, said cable connection hole being spaced from said secondary pivot bolt and a stopper at said distal end of said cable.

9. The apparatus of claim 8, wherein said gate release mechanism further includes a shock absorber having a proximal end and a distal end, said distal end of said shock absorber being pivotally attached to a first pair of spaced mounting brackets on said vertical brace plate by a bolt and nut and said proximal end of said shock absorber being pivotally attached to a second pair of spaced mounting brackets on another of said brace plates fixed between said top and bottom swing plates near said proximal end of said primary pivot arm assembly, said pivotable attachment at said proximal end of said shock absorber being secured between said second pair of mounting brackets by a bolt and nut.

10. The apparatus of claim 9, wherein said gate release mechanism further includes a centering spring assembly having a cylindrical housing, said cylindrical housing having an open proximal end and a closed distal end, said cylindrical housing being fixedly attached between said housings of said first top and bottom spring assemblies, a spring loaded cylinder slidable within said open proximal end and extending partially therefrom, said spring loaded cylinder having a closed end external to said cylindrical housing, a tabbed brace plate secured between said top and bottom swing plates and near said distal end of said primary pivot arm assembly, a pair of spaced brackets secured to said tabbed brace plate and extending perpendicularly therefrom and towards said closed end of said spring loaded cylinder, a roller supported between said pair of spaced brackets and spaced adjacent said closed end of said spring loaded cylinder.

11. The apparatus of claim 10, wherein each of said pair of spaced arcuate plates of said bottom swing plate has a semicircular cutout in axial alignment with each other and forming a detent, a brace plate spaced adjacent said detent and fixedly secured between said top and bottom mounting brackets on said distal end of said arcuate channels, said brace plate having a front planar side and a rear planar side, a plunger assembly having a housing and a round ended plunger, said housing having a proximal end and a distal end, said proximal end of said housing being attached to said rear planar side of said brace plate, and said round ended plunger extending from said proximal end of said housing, through a hole in said brace plate and into said detent.

12. The apparatus of claim 11, wherein said gate release mechanism further includes a primary shear pin extending from a retainer plate on the bottom side of said bottom mounting bracket, through a hole in said bottom mounting bracket, through a hole in said bottom bearing support plate, through a hole in said bottom stop pin and outwardly through a hole in said bottom swing plate.

13. The apparatus of claim 12, wherein said gate release mechanism further includes a secondary shear pin extending though a hole in said proximal end of said top swing plate, through a hole in said elongated arm, and through a hole in said proximal end of said bottom swing plate, said holes being located near said holes for said secondary pivot pin, and said secondary shear pin being supported by a bolt head at the top end thereof.

14. An apparatus for attachment to a support structure for pass and no-pass access across a given passageway, comprising:

a multiple gate release mechanism attached between one end of a horizontally disposed elongated crossing gate and the support structure, said elongated crossing gate mountable at a predetermined distance above ground level, said multiple direction gate release mechanism comprising:

a primary means for returnably rotating a horizontally disposed elongated crossing gate against a first spring bias, in a plane parallel to the ground level, around a pivot, the primary means for rotating in a clockwise direction and a counterclockwise direction; and a secondary means for returnably rotating the horizontally disposed elongated crossing gate against a second spring bias, in the plane parallel to the ground level, around a further pivot, in the counterclockwise direction, wherein the secondary means is pivotally attached to said primary means and is fixedly attached to said horizontally disposed elongated crossing gate.

15. The apparatus of claim 14, wherein said primary pivot gate means includes a first spring biased cable and pivot means for horizontally moving said elongated crossing gate in a clockwise direction and wherein said secondary means includes a second spring biased cable and pivot means for horizontally moving said elongated crossing gate in a counterclockwise direction.

16. The apparatus of claim 15, wherein said gate release mechanism includes a means for automatically returning said elongated crossing gate to a neutral or un-impinged position subsequent to a forcible impingement from either the front or the rear of said elongated crossing gate.

17. The apparatus of claim 16, wherein said means for automatically returning said elongated crossing gate to a neutral or un-impinged position includes said first spring biased cable and pivot means operatively associated with said primary means, said second spring biased cable and pivot, means operatively associated with said secondary means, a shock absorber means pivotally operative with said primary means, and a plunger means operatively associated with a detent in said primary means to maintain said crossing gate in a neutral or un-impinged position.

18. The apparatus of claim 1, wherein the first bias is a spring assembly, the second bias is a spring assembly, and the third bias is a spring assembly.

19. The apparatus of claim 1, wherein a bias force of the third bias is weaker than a further bias force of the first bias.

* * * * *